US009701525B1

(12) United States Patent
Cui et al.

(10) Patent No.: US 9,701,525 B1
(45) Date of Patent: Jul. 11, 2017

(54) ELEVATING LIFT

(71) Applicants: Kan Cui, Mercer Island, WA (US); Margaret C. Liu, Mercer Island, WA (US); Samuel K. Liu, Mercer Island, WA (US)

(72) Inventors: Kan Cui, Mercer Island, WA (US); Margaret C. Liu, Mercer Island, WA (US); Samuel K. Liu, Mercer Island, WA (US)

( * ) Notice: Subject to any disclaimer, the term of this patent is extended or adjusted under 35 U.S.C. 154(b) by 0 days.

(21) Appl. No.: 15/229,096

(22) Filed: Aug. 4, 2016

(51) Int. Cl.
*B66F 11/04* (2006.01)

(52) U.S. Cl.
CPC ..... *B66F 11/04* (2013.01)

(58) Field of Classification Search
CPC ..... B66F 11/04
See application file for complete search history.

(56) References Cited

U.S. PATENT DOCUMENTS

| | | | | | |
|---|---|---|---|---|---|
| 2,183,679 | A | | 12/1939 | Hillis | |
| 2,676,677 | A | | 4/1954 | Anderson et al. | |
| 3,056,465 | A | * | 10/1962 | Gerrans | A01D 46/20 182/148 |
| 3,180,450 | A | | 4/1965 | Crager et al. | |
| 3,236,329 | A | | 2/1966 | Price | |
| 3,871,478 | A | | 3/1975 | Cushnell, Jr. | |
| 4,390,080 | A | * | 6/1983 | Bushnell, Jr. | B66F 11/04 182/115 |
| 4,444,540 | A | * | 4/1984 | Blatt | B21D 43/105 414/589 |
| 4,555,138 | A | | 11/1985 | Hughes | |
| 4,589,520 | A | * | 5/1986 | Tapfer | B66F 11/04 182/46 |
| 4,657,112 | A | * | 4/1987 | Ream | B66F 11/04 182/127 |
| 5,203,425 | A | | 4/1993 | Wehmeyer | |
| 5,586,616 | A | * | 12/1996 | Ksenych | B66F 11/04 182/148 |
| 6,430,761 | B1 | | 8/2002 | Brandorff et al. | |
| 6,435,048 | B1 | | 8/2002 | Zimmerman | |
| 7,966,777 | B2 | | 6/2011 | Douglas et al. | |
| 2009/0096231 | A1 | * | 4/2009 | Burlingame | B66F 11/04 294/68.3 |

FOREIGN PATENT DOCUMENTS

| | | |
|---|---|---|
| CN | 204702479 U | 10/2015 |
| FR | 2 591 821 | 6/1987 |

* cited by examiner

*Primary Examiner* — Alvin Chin-Shue
(74) *Attorney, Agent, or Firm* — Richard C. Litman

(57) ABSTRACT

The elevating lift includes a stabilizer base with extendable legs to provide minimum to maximum stability during use and transport. A lift system is fixed to the stabilizer base, and a platform assembly is mounted to the top of the base to be selectively raised or lowered by the lift system. The lift system utilizes a plurality of telescoping cage assemblies interconnected to extend or retract relative to each other. A drive assembly with an extendable lift mast is mounted to the stabilizer base to act on the cage assemblies to raise or lower the same. A drive train coupled to the telescoping cage assemblies enables relative extension and retraction of the cage assemblies. An adjustable guardrail is mounted to a platform of the platform assembly to provide safety for the user.

12 Claims, 11 Drawing Sheets

ELEVATING LIFT

BACKGROUND OF THE INVENTION

1. Field of the Invention

The present invention relates to lift devices, and particularly to an elevating lift with enhanced stability and a robust lift system.

2. Description of the Related Art

Many lifting devices exist to assist users gain access to elevated areas difficult to reach through most conventional means such as stretching towards maximum reach of the user's physical ability, ladders, and the like. In the case of manual reaching, any activity performed while stretching to reach the desired area is rather limited by the user's physical endurance in maintaining the stretched position. Most ladders, while useful, tend to be rather lackluster in terms of stability due to their design and function where the ladder leans against a surface with only the legs and abutting portions providing the necessary stability. Depending on the extent of the ground surface level, the stability of a ladder may be compromised if the ground surface is uneven, which requires buttressing by additional features on the ladder or an additional person.

Powered lifters are also available for more heavy duty or industrial applications. These types of devices provide great utility due to the weight that can be supported, which allows for larger amount of supplies, tools, and/or cargo to be carried, and the relatively large base supporting the platform and lift system. However, these types of lifters tend to be rather large, employ relatively complex lift systems, such as a scissor lift, and/or utilize a single telescoping mast that may lose structural integrity or provide reduced stability over time. Moreover, most of these power lifters tend to be unsuitable for personal applications due to the relatively large and cumbersome design.

In light of the above, it would be a benefit in the art of lift devices to provide a lift of suitable size and configuration for personal use with a relatively robust and simple lift system. Thus, an elevating lift solving the aforementioned problems is desired.

SUMMARY OF THE INVENTION

The elevating lift includes a stabilizer base with extendable legs to provide minimum to maximum stability during use and transport. A lift system is fixed to the stabilizer base, and a platform assembly is mounted to the top of the base to be selectively raised or lowered by the lift system. The lift system utilizes three telescoping cage assemblies interconnected to extend or retract relative to each other. A drive assembly with an extendable lift mast is mounted to the stabilizer base to act on the cage assemblies to raise or lower the same. A drive train coupled to the telescoping cage assemblies enables relative extension and retraction of the cage assemblies. An adjustable guardrail is mounted to a platform of the platform assembly to provide safety for the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
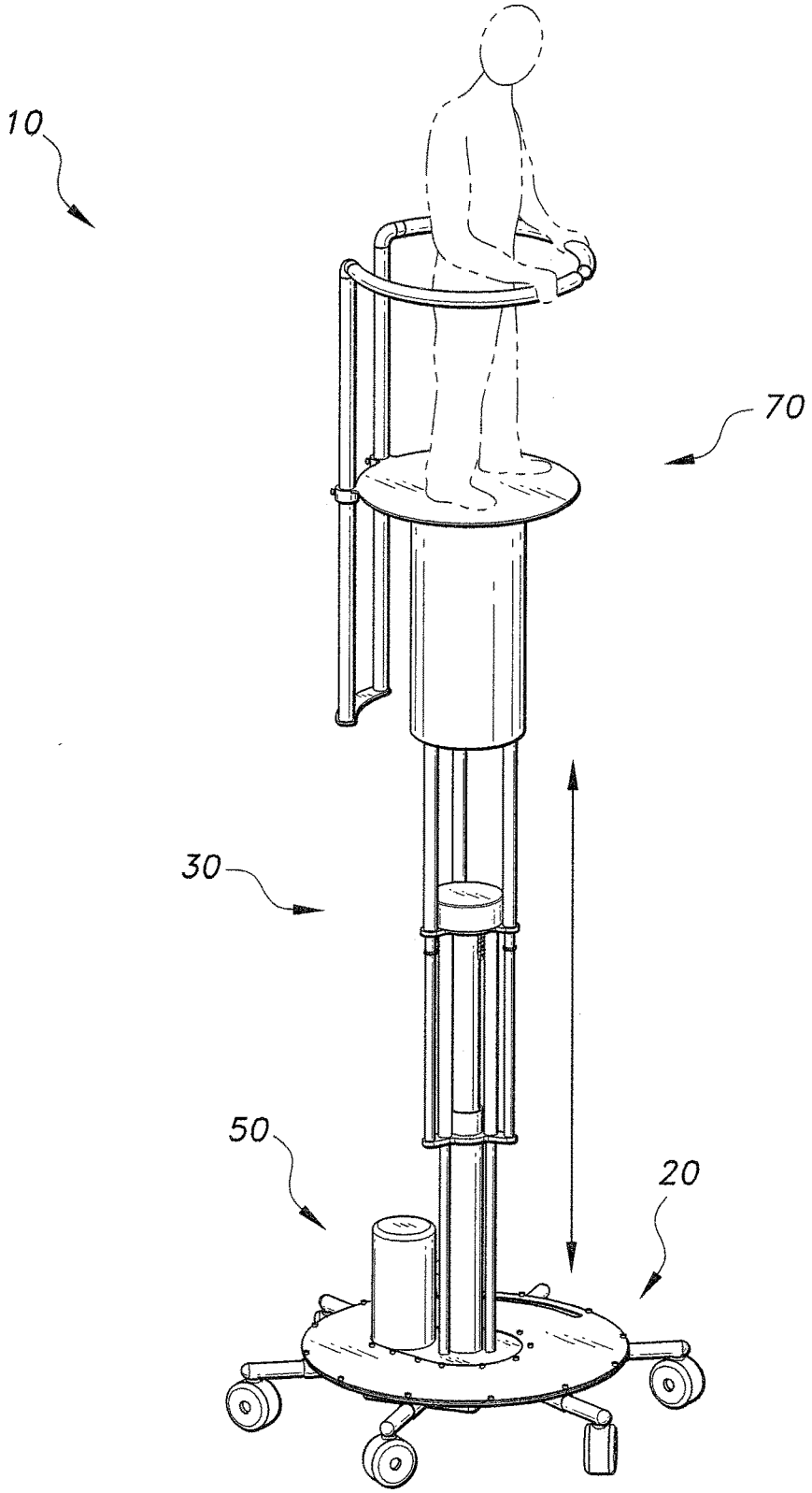
FIG. 1 is an environmental, perspective view of an elevating lift according to the present invention.

The elevating lift, a first embodiment of which is generally referred to by the reference number 10 in the Figures, provides a stable, safe, and versatile lift in a relatively simple and small form factor. The elevating lift 10 includes a stabilizer base assembly 20, a selectively extendable lift system 30 extending upwardly from the stabilizer base assembly 20, and a platform assembly 70 coupled to the top of the lift system 30.

As best seen in FIGS. 1, 2, 8A, and 8B, the stabilizer base assembly 20 supports the lift system 30 and includes a movable base 21. A plurality of selectively extendable casters 24 is coupled to the movable base 21 to enable selective transport of the elevating lift 10 to a desired location. The movable base 21 is preferably generally circular in shape for simplicity of construction and operation. It is noted, however, that the movable base 21 may assume any desired or required shape depending on the application.

A plurality of elongate support spokes 22 extend radially from a central hub 21*a* within the movable base 21 at predetermined angular spacing. Each support spoke 22 is preferably a hollow pipe of a give length and includes an elongate guide slot 22*a*. An elongate support rod or leg 23 is attached to a corresponding caster 24 at one end. An actuator rod or pin 23*a* extends radially from the opposite end of the support leg 23. Each support leg 23 is slidably received in the corresponding support spoke 22 with the actuator pin 23*a* extending through the guide slot 22*a*. This configuration enables the casters 24 to selectively reciprocate along the guide slot 22*a* with the actuator pin 23*a* riding therein. The guide slot 22*a* defines the limits of movement for the corresponding actuator pin 23*a*. The actuator pin 23*a* also serves as a stop preventing the corresponding support leg 23 from accidental or undesirable disengagement with the support spoke 22. Selective extension of the casters 24 with respect to the movable base 21 expands the footprint of the base assembly 10 with respect to the ground or support surface thereby providing increased stability to the elevating lift 10 the further the casters 24 have been extended. It is noted that though the Figures depict circular configurations of the support spokes 22 and support legs 23, these features may be provided in any desired or required shapes, such as square, rectangular, hexagonal, or any other geometric shapes and combinations thereof, so long as the support leg 23 can reciprocate within the support spoke 22. Each caster 24 may also be provided with a locking mechanism (not shown) as known in the art to prevent undesirable movement once the elevating lift 10 has been set in place.

To enable selective extension and retraction of the casters 24 with respect to the movable base 21, the base assembly 20 includes an annular, rotary stabilizing actuator 25 rotatably mounted to the hub 21*a* of the movable base 21. The stabilizing actuator 25 is preferably an annular plate with a plurality of actuator slots 25*a* formed thereon. Each actuator slot 25*a* is preferably an arcuate slot configured to receive one of the actuator pins 23*a* therein. Each actuator pin 23*a* is adapted to ride within the corresponding actuator slot 25*a* between fully extended and fully retracted positions depending on the rotated position of the stabilizing actuator 25.

The curvature, dimensions, and placement of the actuator slots 25*a* preferably follow an Archimedean spiral so that for a given angular rotation of the stabilizing actuator 25, each support leg 23 extends and retracts at a constant, respective rate. This rate may be the same or different for each support leg 23 depending on the factors mentioned above as well as the lengths of each support leg 23. However, the connection of the actuator pins 23*a* to the common stabilizing actuator 25 insures simultaneous operation or reciprocating movements of the casters 24. This type of operation and configuration is taught by U.S. Pat. No. 9,068,634, which is hereby incorporated by reference in its entirety. Other approximate curves that approach Archimedean spirals may also be used.

To enable selective rotation of the stabilizing actuator 25, the stabilizing actuator 25 includes a handle 26 extending from the upper face of the stabilizing actuator 25 near the periphery thereof at a fixed, offset axis with respect to the axis of the base 21. A base cover 27 covers the stabilizing actuator 25 and includes an arcuate guide slot 27*a* formed thereon. The handle 26 extends through the guide slot 27*a*. The guide slot 27*a* follows a predefined angular segment of a circle due to the fixed radial distance of the handle 26 from the axis of the base 21. This angular segment defines the extent of rotation required to fully extend or retract the support legs 23. Selective manual operation of the handle 26 by the user between the extreme ends of the guide slot 27*a* facilitates rotation of the stabilizing actuator 25 thereby enabling the casters 24 to extend and retract with respect to the base 21. Although manual, it is noted that similar operation may be powered or automated.

As best seen in FIGS. 1 and 3-6, the stabilizer base assembly 20 supports the lift system 30, and the lift system 30 extends axially therefrom. The lift system 30 enables selective, positive elevation of the platform assembly 70 between the lowermost position shown in FIG. 2, the highest position shown in FIG. 1, and any position therebetween. The lift system 30 includes a telescoping cage assembly 40, a drive assembly 50, and a drive train 60 coupled to the telescoping cage assembly 40 and the drive assembly 50 to facilitate raising and lowering of the platform assembly 70 upon selective activation of the drive assembly 50.

Figure 3:
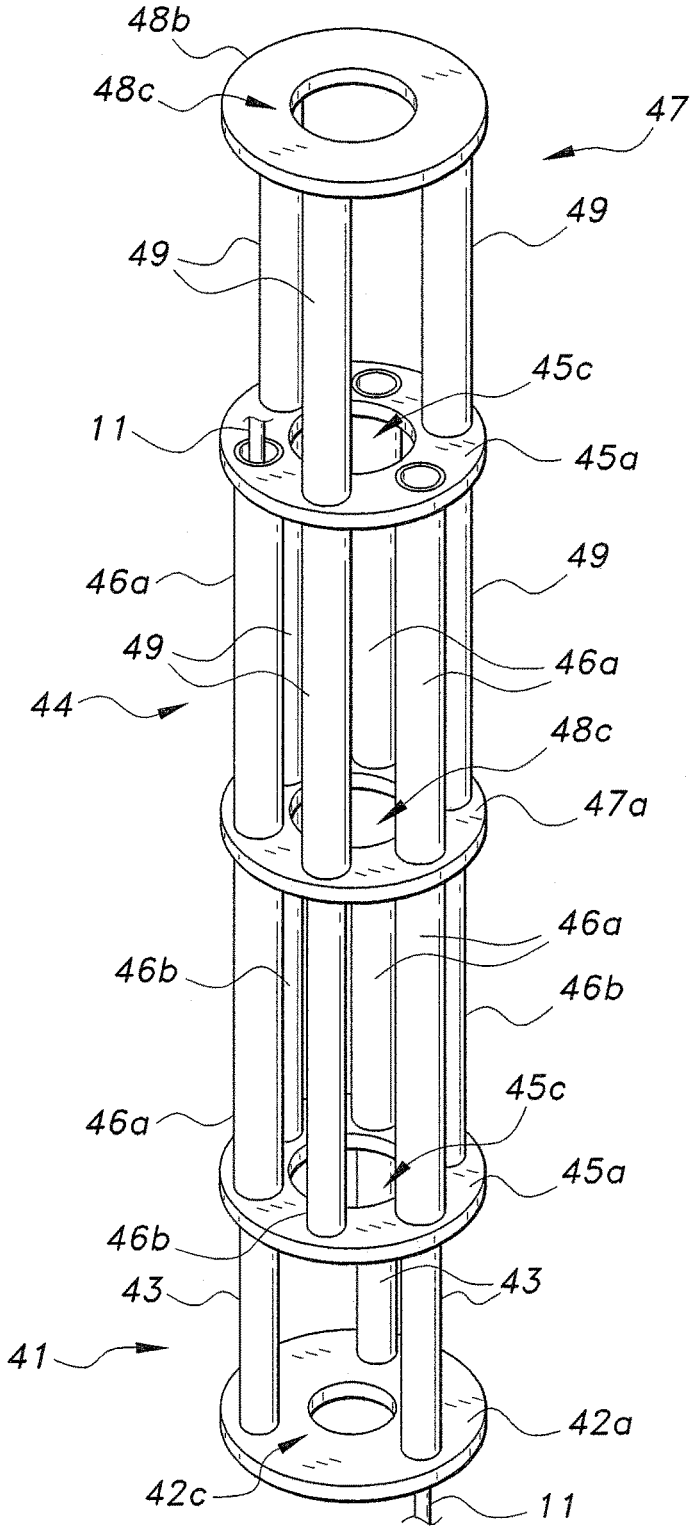
FIG. 3 is a perspective view of a lift cage assembly in the elevating lift shown in FIG. 1.
Figure 4:
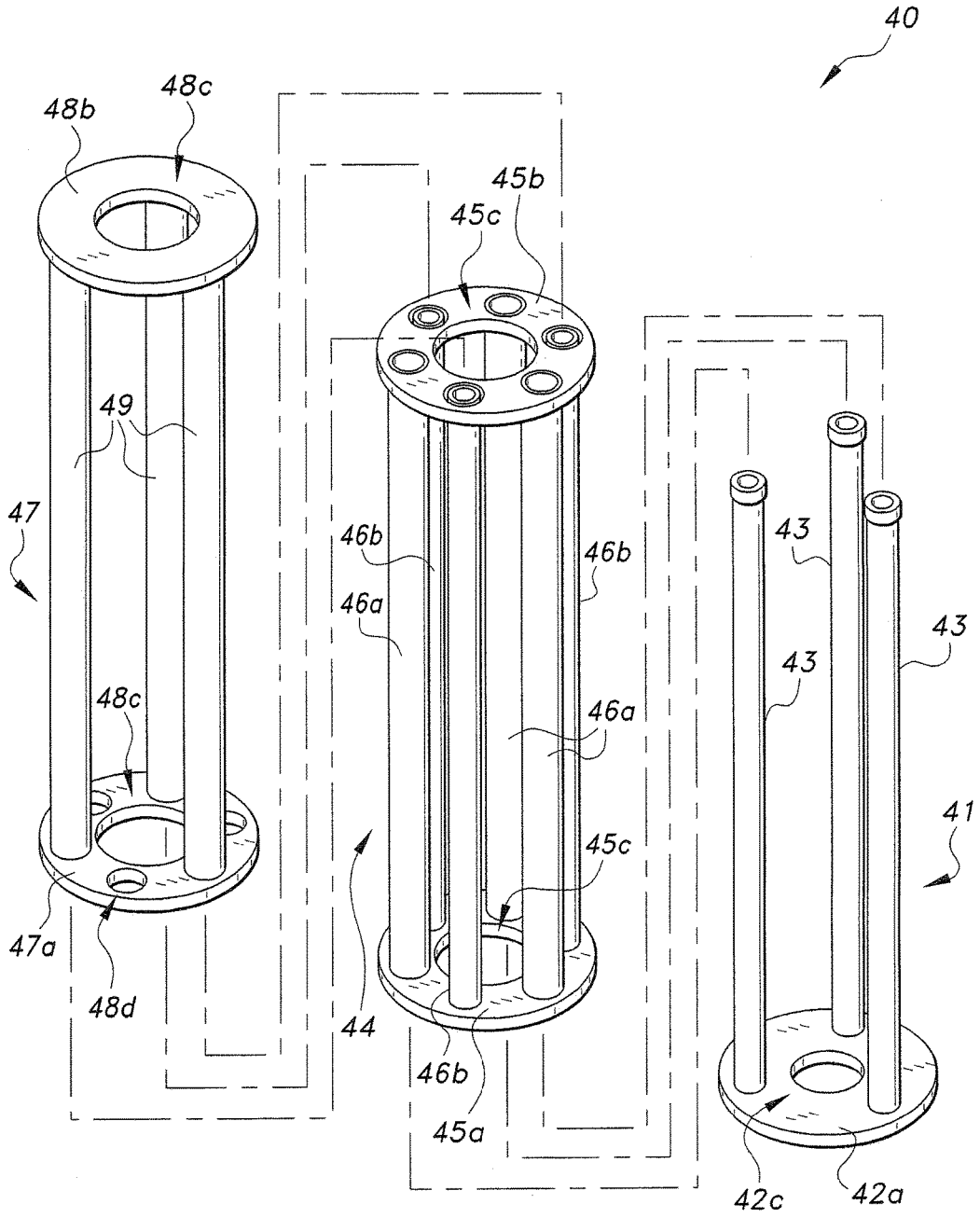
FIG. 4 is a partial exploded view of the lift cage assembly shown in FIG. 3.

A first embodiment of a telescoping cage assembly 40 is shown in FIGS. 3 and 4. The telescoping cage assembly 40 includes a first telescoping cage 41, a second telescoping cage 44 slidably coupled to the first telescoping cage 41, and a third telescoping cage 47 slidably coupled to the second telescoping cage 44. Each first, second, and third telescoping cages 41, 44, 47 form a generally cage configuration, and hence use of the term "cage." The first telescoping cage 41 comprises an endcap 42*a* forming a base for the cage configuration. The endcap 42*a* is preferably an annular plate, though other geometrically shaped and/or spoked plates may be used. The concentric hole 42*c* permits parts of the drive assembly 50 to extend therethrough. A plurality of elongate, angularly spaced, first support beams 43 extend axially from one face of the endcap 42*a* to form a general, cylindrical cage shape. The first support beams 43 are preferably hollow pipes of a given first diameter and equal length. This configuration also results in a relatively lightweight yet sturdy structure. In this embodiment, the first cage 41 is provided with three first support beams 43.

The second telescoping cage 44 includes a first endcap 45*a* and a second endcap 45*b* spaced from the first endcap 45*a*. Each of the endcaps 45*a*, 45*b* is preferably an annular plate, though other geometrically shaped and/or spoked plates may be used. A concentric hole 45*c* is formed in each endcap 45*a*, 45*b* to permit parts of the drive assembly 50 to extend therethrough and reside therein when in the normal unelevated state shown in FIG. 2. A plurality of elongate, angularly spaced, first support beams 46*a* and second support beams 46*b* extend axially between the first endcap 45*a* and the second endcap 45*b* to form a general, cylindrical cage shape. The first support beams 46*a* and the second support beams 46*b* are preferably hollow pipes of a given first diameter and second diameter, respectively, the first diameter being different from the second diameter, e.g., the diameter of the first support beams 46*a* being larger than the diameter of the second support beams 46*b*. These beams 46*a*, 46*b* are also equal in length, and one end of these beams 46*a*, 46*b* are fixed to the first endcap 45*a*.

As best seen in FIGS. 3 and 4, each endcap 45*a*, 45*b* includes a plurality of holes for mounting the ends of the first and second support beams 46*a*, 46*b*. The first and second support beams 46*a*, 46*b* are also arranged in alternating order in the cage configuration. Due to this arrangement, one set of holes in the second endcap 45*b* fixedly accommodates the opposite end of the first support beams 46*a* while the remainder of the holes freely accommodates the opposite end of the second support beams 46*b*. In this example, the first support beams 46*a* of the second telescoping cage 44 are relatively large in diameter so as to slidably receive the first support beams 43 of the first telescoping cage 41 to enable relative telescoping movement between the first telescoping cage 41 and the second telescoping cage 44.

The third telescoping cage 47 includes a first endcap 48*a* and a second endcap 48*b* spaced from the first endcap 48*a*. Each of the endcaps 48*a*, 48*b* is preferably an annular plate, though other geometrically shaped and/or spoked plates may be used. A concentric hole 48*c* is formed in each endcap 48*a*, 48*b* to permit parts of the drive assembly 50 to extend therethrough and reside therein when in the normal unelevated state shown in FIG. 2. A plurality of elongate, angularly spaced, first support beams 49 extend axially between the first endcap 48*a* and the second endcap 48*b* to form a general, cylindrical cage shape. The support beams 49 are preferably hollow pipes of a given diameter. These beams 49 are also equal in length.

As best seen in FIGS. 3 and 4, each endcap 48*a*, 48*b* includes a plurality of holes for mounting the ends of the first support beams 49. The first, second, and third telescoping cages 41, 44, 47 are interconnected when assembled, and the arrangement of the holes in the endplates and angular placement of the support beams enable the cages to reciprocate with respect to each other. For example, the first telescoping cage 41 serves as a base for the telescoping cage assembly 40. To mount the second telescoping cage 44 to the first telescoping cage 41, the first endcap 45*a* slides over the first support beams 43 of the first telescoping cage 41. One end of the first and second beams 46*a*, 46*b* may be fixed to the first endcap 45*a* before or after mounting the first endcap 45*a*. The first support beams 46*a* of the second telescoping cage 44 slides over the first support beams 43 of the first telescoping cage 41.

To mount the third telescoping cage 47, the first endcap 48*a* of the third telescoping cage 47 slides over the first and second support beams 46*a*, 46*b* of the second telescoping cage 44. The second endcap 45*b* of the second telescoping cage 44 is mounted to the opposite ends of the first and second support beams 46*a*, 46*b* as shown in FIG. 3 so that the first endcap 48*a* of the third telescoping cage 47 is disposed below the first endcap 45*a* of the second telescoping cage 44. The first support beams 49 of the third telescoping cage 47 slides over the second support beams 46*b* of the second telescoping cage 44 with one end fixed to the first endcap 48*a* of the third telescoping cage 47. The second endcap 48*b* covers the opposite end of the first support beams 49 trapping the second endcap 45*b* for sliding movement between the first endcap 48*a* and the second endcap 48*b* of the third telescoping cage 47.

In another arrangement, the first endcap 48*a* may be removed from the third telescoping cage 47 so that the second endcap 45*b* of the second telescoping cage 44 serves as a common endcap between the second telescoping cage 44 and the third telescoping cage 47. Drive lines 11 extending through some of the support beams illustrate some features of the drive train assembly 60 that enable the telescoping cages 41, 44, 47 to reciprocate relative to each other.

Figure 5:
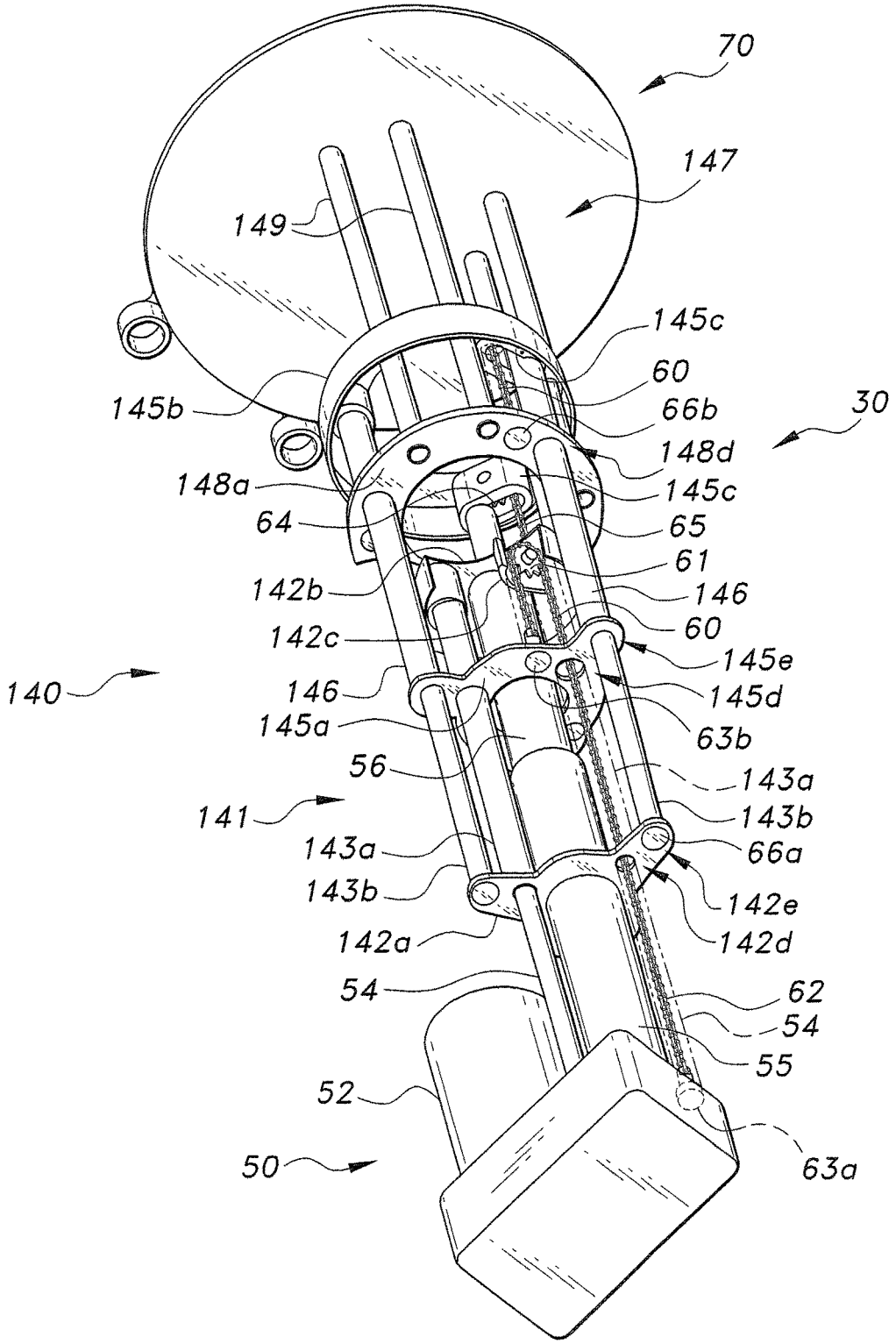
FIG. 5 is a bottom perspective view of a lift system for the elevating lift shown in FIG. 1.
Figure 6:
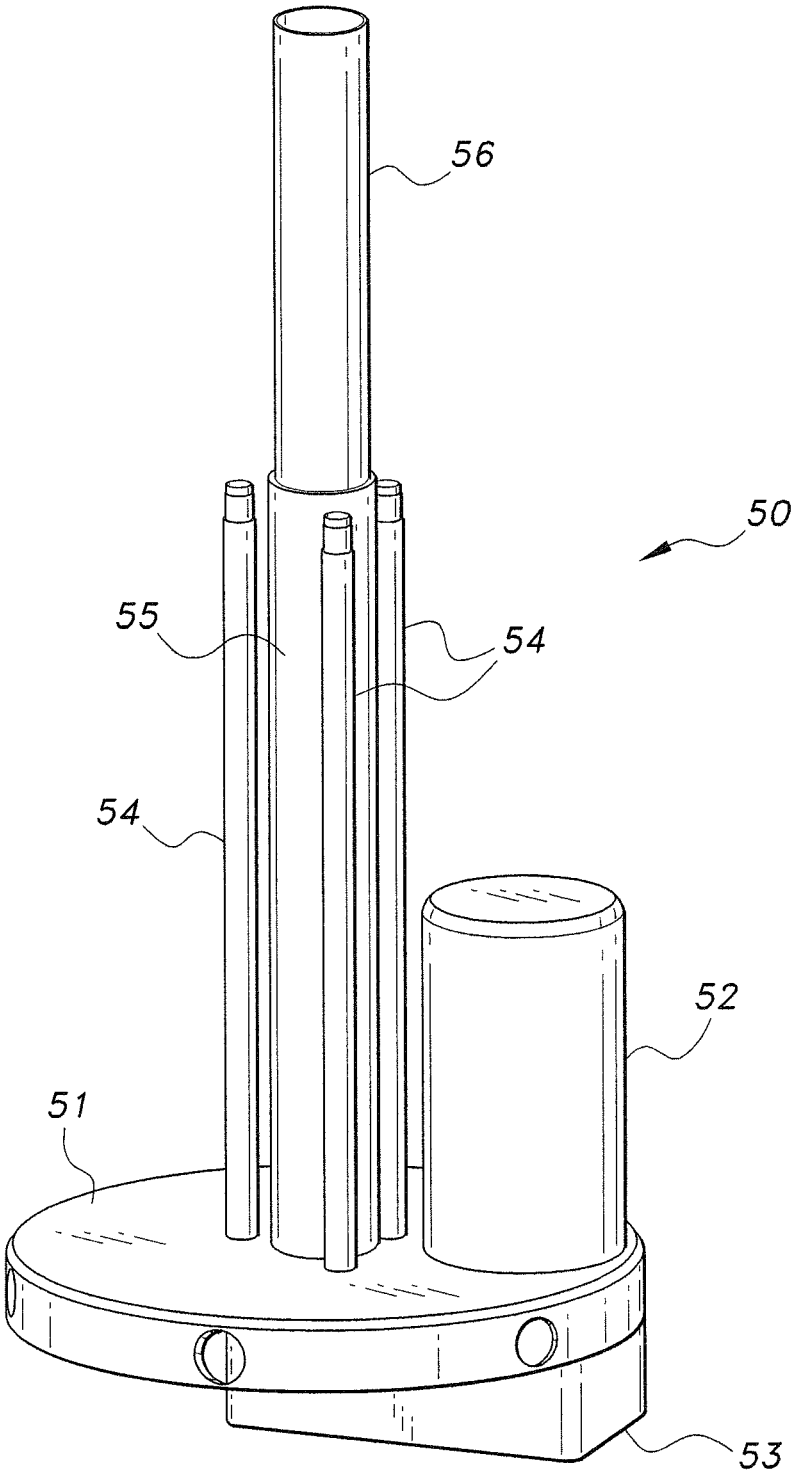
FIG. 6 is a perspective view of a drive assembly for the elevating lift shown in FIG. 1.
Figure 8A:
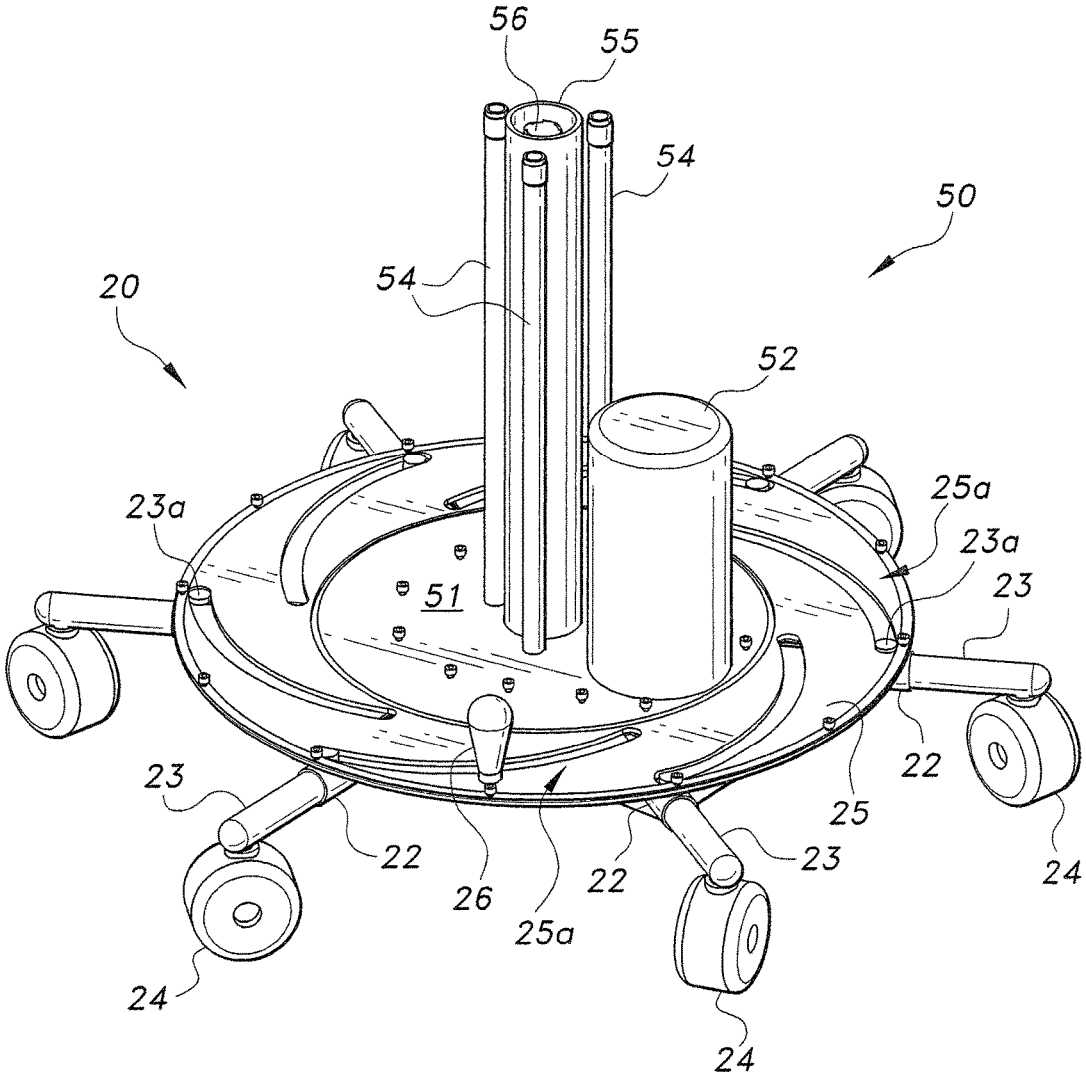
FIG. 8A is a perspective view of an extension assembly for a base in the elevating lift shown in FIG. 1 with a cover removed for clarity.
Figure 8B:
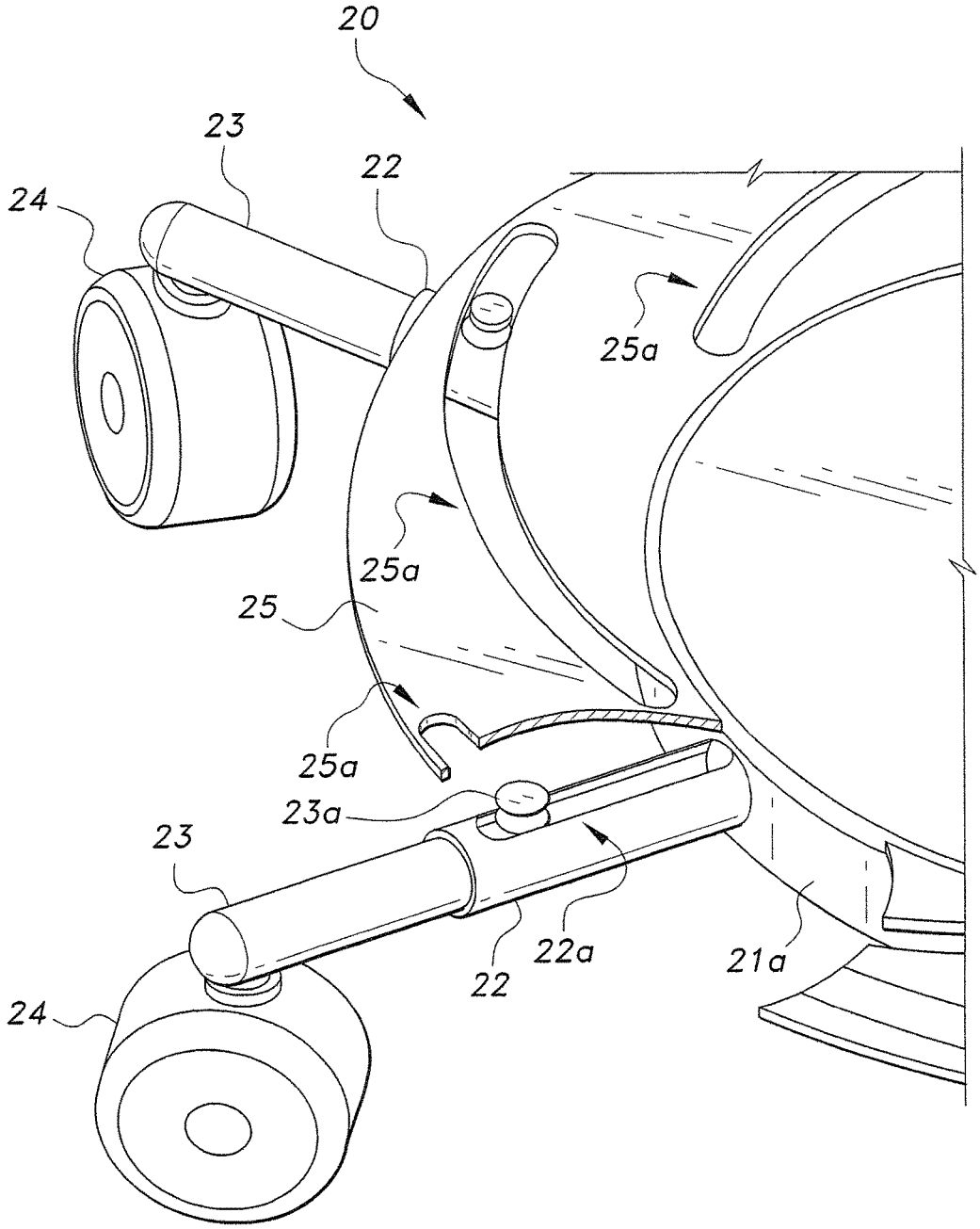
FIG. 8B is a detailed view of the extension assembly shown in FIG. 8A.

As best seen in FIGS. 5, 6, and 8A, the drive assembly 50 is mounted to the stabilizer base assembly 20, and selective operation thereof facilitates selective extension and retraction of the telescoping cage assembly 40. The drive assembly 50 includes a drive base 51 mounted to the movable base 21, preferably at the center of mass. A lift motor 52 is mounted to the drive base 51 to provide power for a linear actuator. The linear actuator includes a mast support cylinder 55 and a lift mast 56 selectively extendable from within the mast support cylinder 55. A gearbox 53 couples the motor 51 to the lift mast 56 to enable selective extension of the lift mast 56. A plurality of elongate, angularly spaced guide posts 55 extends upwardly from the drive base 51. These guide posts 54 are arranged around the mast support cylinder 55 and, when assembled, slidably received in respective first support beams 43 of the first telescoping cage 41. By this construction, the guide posts 54 linearly guide the movements of the first telescoping cage 41 and thereby the second and third telescoping cages 44, 47.

FIG. 5 illustrates the drive assembly 50 operating in combination with the drive train 60 and another embodiment of a telescoping cage assembly 140. Beginning with the telescoping cage assembly 140, the telescoping cage assembly 140 includes a first telescoping cage 141, a second telescoping cage 144 slidably coupled to the first telescoping cage 141, and a third telescoping cage 147 slidably coupled to the second telescoping cage 144.

The first telescoping cage 141 comprises a first endcap 142*a* forming a base for the cage configuration. The first endcap 142*a* is preferably an annular plate with a plurality of radial tabs. Each radial tab is provided with a pair of inner and outer holes 142*d*, 142*e*. One end of an elongate, first support beam 143*a* is fixed to each inner hole 142*d*. The opposite end of the first support beams 143*a* is mounted to a second endcap 142*b*. The second endcap 142*b* is preferably configured as a generally flanged, closed cap with angularly spaced mounting hubs 142*c* extending downward. As shown in FIG. 5, portions of the second endcap 142*b* and the mounting hub 142*c* have been removed for clarity. It is noted, however, that portions of the second endcap 142*b* may also be removed or cutout to provide clearance for the motor 52. The opposite end of the first support beams 143*a* are connected to the mounting hubs 143*c*. Each mounting hub 143*c* also houses components of the drive train 60. In assembly, each inner hole 142*d* is adapted to slidably receive a corresponding guide post 55 therethrough. One end of a plurality of second support beams 143*b* extend axially from the outer holes 142*e* towards the second endcap 142*b*.

The second telescoping cage 144 is similarly configured as the first telescoping cage 141. The second telescoping cage 144 includes a first endcap 145*a* similar to the previously described first endcap 142*a*. The first endcap 145*a* is provided with pairs of inner and outer holes 145*d*, 145*e*. A second endcap 145*b*, spaced from the first endcap 145*a*, define opposite ends of the second telescoping cage 144. The second endcap 145*b* is preferably configured as a generally flanged, annular hub with angularly spaced mounting hubs 145*c* extending downward. These mounting hubs 145*c* house components of the drive train 60. A plurality of elongate, angularly spaced, support beams 146 extend between the mounting hubs 145*c* and the outer holes 145*e* to form a general cage. The support beams 146 are preferably hollow to enable slidable reception of the second support beams 143*b* from the first telescoping cage 141 when assembled. Meanwhile, the inner holes 145*d* in the first endcap 145*a* enable pass through of the first support beams 143*a* in the first telescoping cage 141 from the first endcap 142*a* towards the second endcap 142*b*.

The third telescoping cage 147 includes a first endcap 148*a* and a plurality of spaced, elongate support beams 149 extending axially from one face of the first endcap 148*a*. The first endcap 148*a* is preferably an annular plate provided with a plurality of spaced holes 148*d*. The holes 148*d* enable pass through of the support beams 146 from the second telescoping cage 144 towards the second endcap 145*b* thereof. The third telescoping cage 147 may be provided with a spaced second endcap as described and shown in FIGS. 3 and 4, or the support beams 149 may terminate at the platform assembly 70 as shown in FIG. 5, the second endcap 145*b* of the second telescoping cage 144 being disposed and reciprocable between the first endcap 148*a* of the third telescoping cage 147 and the platform assembly 70.

The drive train 60 facilitates relative reciprocal movement between the first telescoping cage 141 and the second telescoping cage 144 and between the second telescoping cage 144 and the third telescoping cage 147 in response to the selective extension of the lift mast 56. The drive train 60 includes a first chain drive coupled to the first telescoping cage 141 and the second telescoping cage 144 and a second chain drive coupled to the second telescoping cage 144 and the third telescoping cage 147.

As best seen in FIG. 5, the first chain drive comprises a rotary sprocket 61 rotatably mounted to each mounting hub 142*c* on the second hub 142*b* of the first telescoping cage 144. A chain 62 of predefined fixed length connects the first telescoping cage 141, the second telescoping cage 144, and the drive base 51. Opposite ends of the chain 62 is provided with a first anchor 63*a* and a second anchor 63*b*, respectively. The first anchor 63*a* is preferably fixed to the drive base 51 while the opposite, second anchor 63*b* is fixed to a provided hole or anchor point near the inner hole 145*d* on the first endcap 145*a* of the second telescoping cage 144.

The chain 62 is trained so that the chain 62, from the first anchor 63*a*, passes through the guide posts 54 and the coaxial first support beams 143*a* of the first telescoping cage 141, around the corresponding sprocket 61, and terminate at the second anchor 63*b* on the first endcap 145*a*. The distal end of the lift mast 56 is coupled to or pushes against the underside of the second endcap 142*b* of the first telescoping cage 141 to enable the selective raising of the cages 141, 144, 147.

The arrangement of the second chain drive is similar. As best seen in FIG. 5, the second chain drive comprises a rotary sprocket 64 rotatably mounted to each mounting hub 145*c* on the second hub 145*b* of the second telescoping cage 144. A chain 65 of predefined fixed length connects the first telescoping cage 141, the second telescoping cage 144, and the third telescoping cage 147. Opposite ends of the chain 65 is provided with a first anchor 66*a* and a second anchor 66*b*, respectively. The first anchor 66*a* is preferably fixed to the first endcap 142*a* of the first telescoping cage 141 while the opposite, second anchor 66*b* is fixed to a provided hole or anchor point near the hole 148 on the first endcap 148*a* of the third telescoping cage 147. The chain 65 is trained so that the chain 65, from the first anchor 66*a*, passes through the second support beams 143*b* of the first telescoping cage 141 and the coaxial support beams 146 of the second telescoping cage 144, around the corresponding sprocket 64, and terminates at the second anchor 63*b* on the first endcap 148*a*.

Figure 2:
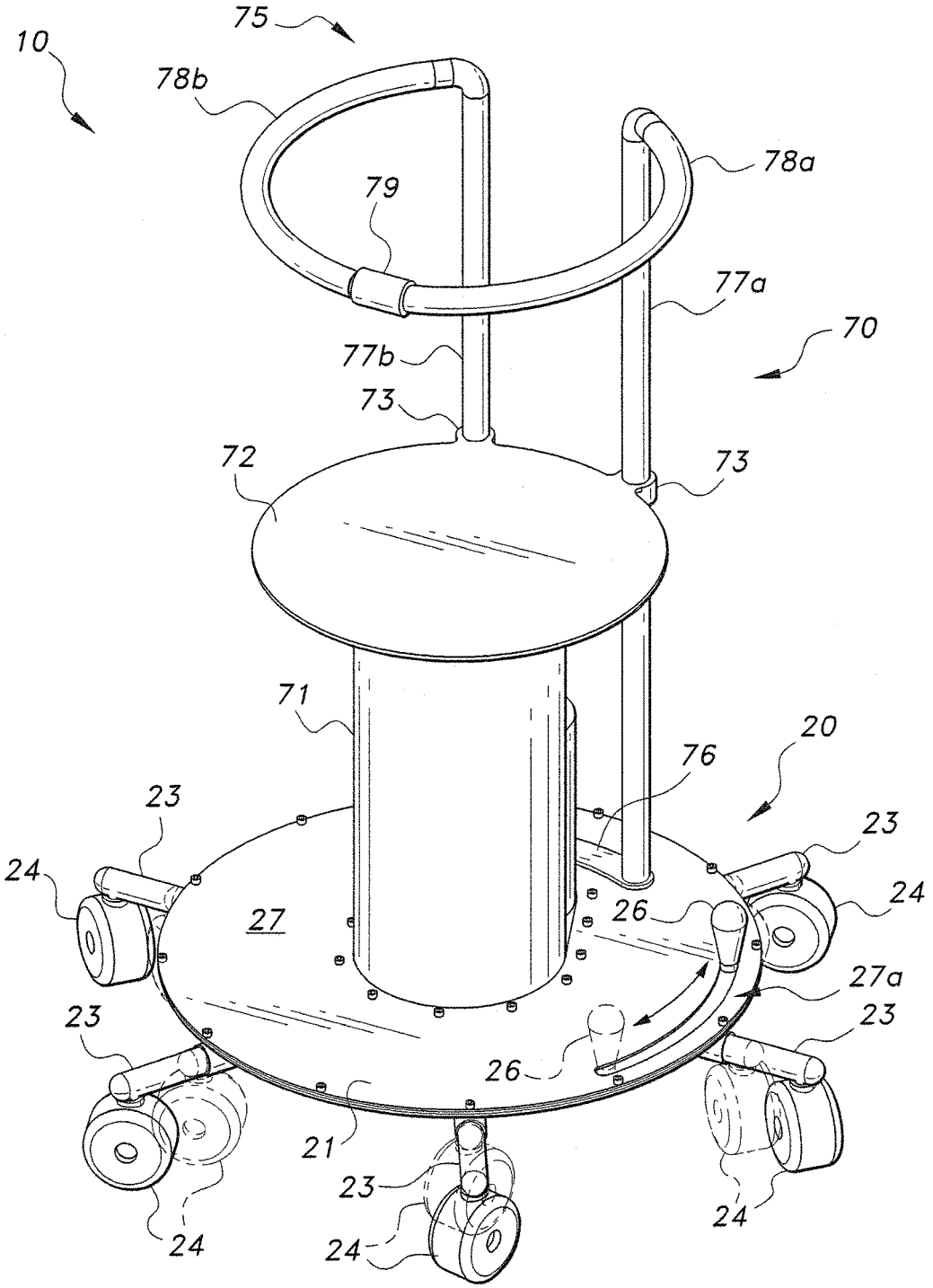
FIG. 2 is a perspective view of the elevating lift shown in FIG. 1.

In use, from the normally lowered position shown in FIG. 2, selective extension of the lift mast 56 forces the first support cage 141 to lift with respect to the drive base 51. This causes the chain 62 to unwind around the sprocket 61 and simultaneously lift or extend the second telescoping cage 144 with respect to the first telescoping cage 141 due to the second anchor 63*b* being fixed to the first endcap 145*a* of the second telescoping cage 144. The extending movement of the second telescoping cage 144 also causes the third telescoping cage 147 to extend with respect to the second telescoping cage 144 due to the anchor points, first anchor 66*a* at the first endcap 142*a* of the first telescoping cage 141 and the second anchor 66*b* at the first endcap 148*a* of the third telescoping cage 147, and the relative movements thereof. When work is completed or higher elevation is no longer needed, the telescoping cage assembly 140 may be collapsed by lowering the lift mast 56 and allowing the weight of the cages 141, 144, 147 and/or objects or users on the platform assembly 70 to lower the anchor points on the cages.

It is to be noted that drive assembly 50 may incorporate any type of power drives, such as combustion, electric, pneumatic, and hydraulic power systems. Moreover, the drive train 60 may utilize other types of drive trains such as belts and cables as well as pulleys. Besides the drive system for the elevating lift 10, the cage-like construction of the telescoping cage assembly 40, 140 provides a very sturdy and stable structure for raising and lowering the platform assembly 70 compared to most conventional lifts that use a single telescoping mast.

The platform assembly 70 provides space to support the user and any necessary supplies and equipment. As shown in the Figures, the platform assembly 70 includes a platform base 71, a level platform 72, and a guardrail 75. In a first embodiment, the platform base 71 is preferably an elongate sleeve covering the height of the telescoping cage assembly 40, 140 when in a collapsed state as shown in FIG. 2. The platform 72 is also preferably a generally circular disc with suitable room for the user to stand or sit thereon. The platform 72 is constructed to provide at least two degrees of adjustable positioning movement, the first being elevated positioning via selective extension and retraction of the telescoping cage assembly 40, 140, and the second being rotatably or angularly positioned about the central axis of the lift system 30. This enables the user to set the desired height and rotate as required to reach the work area. Though a disc shape is preferred, the platform 72 may be constructed as any shape suitable for supporting user(s), supplies and/or equipment, e.g., square, rectangle, and other geometric shapes. One or more mount collars 73 extend radially from the periphery of the platform 72 to enable slidable mounting of the guardrail 75.

The guardrail 75 is a safety feature for the user to prevent potential accidents and harm. In one embodiment, the guardrail 75 comprises an arcuate bridge plate 76 forming a base for the guardrail 75. One end of a pair of elongate, first and second legs 77*a*, 77*b* is fixed to opposite ends of the bridge plate 76 and extends upwardly from opposite ends of the bridge plate 76. Each leg 77*a*, 77*b* passes through a corresponding mount collar 73. Two halves of a generally semicircular hand bar, a first hand bar 78*a* and a second hand bar 78*b*, extend orthogonally from corresponding opposite ends of the legs 77*a*, 77*b*. These hand bars 78*a*, 78*b* preferably follow the general outline of the platform 72. Each hand bar 78*a*, 78*b* is configured so as to rotate about the axis of the attached leg 77*a*, 77*b* between open and closed positions, the closed position shown in FIG. 2 and the open position shown in FIG. 7. To maintain the closed position, the guardrail 75 is provided with a lock 79 that locks the ends of the hand bars 78*a*, 78*b* to form a general circular barrier around the user.

Figure 7:
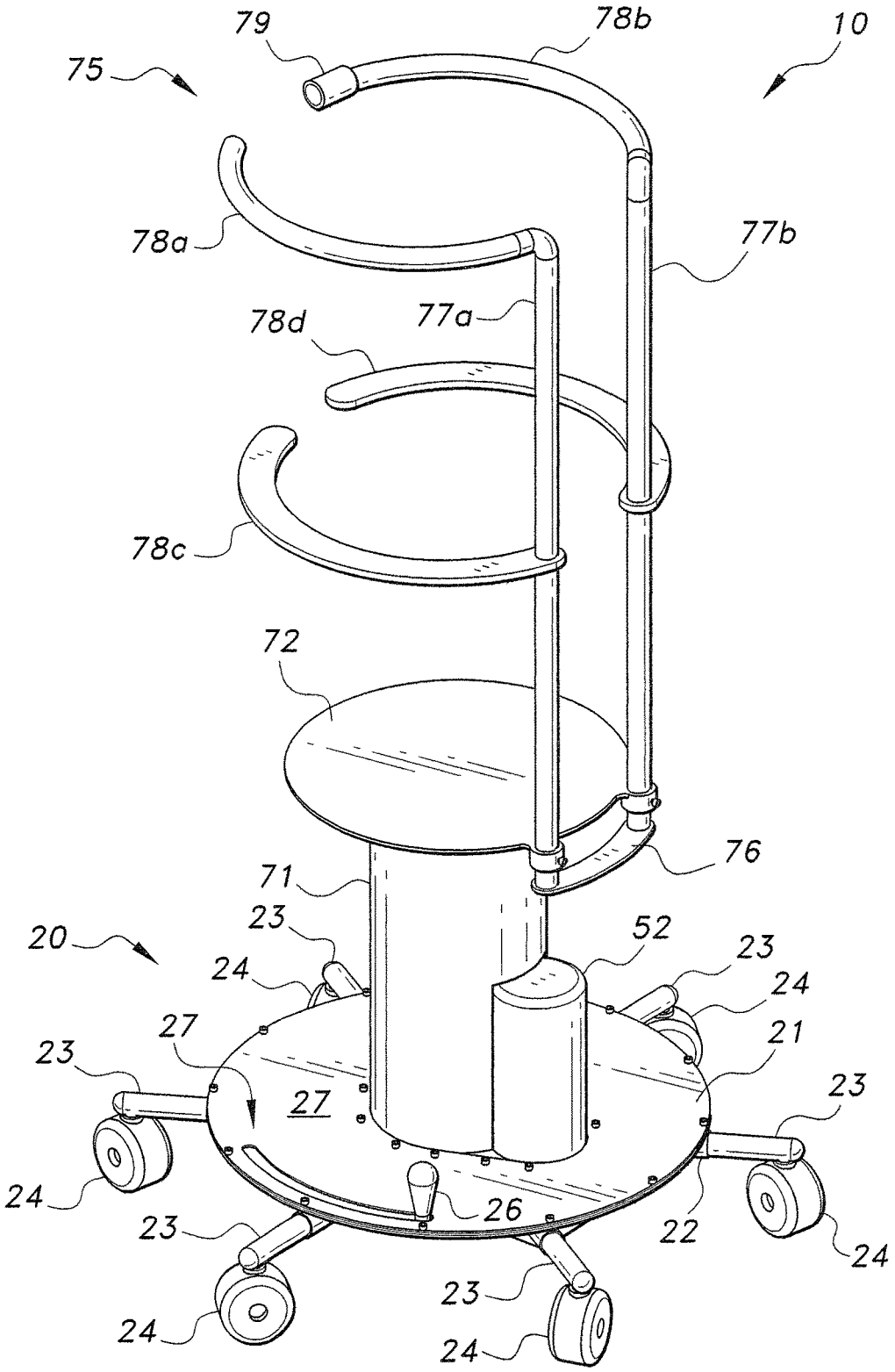
FIG. 7 is a perspective view of an alternative guard rail for the elevating lift shown in FIG. 1.

In use, the mount collars 73 enable vertical adjustment of the guard rail 75 to position the hand bars 78*a*, 78*a* at a user-defined height. The height may be set by any conventional latch, lock, or fastener above or on the mount collar 73. The bridge plate 76 also serves as a stop defining the maximum height adjustment for the guardrail 75. As shown in FIG. 7, the guard rail 75 may be provided with an additional pair of hand bars, a third hand bar 78*c* and a fourth hand bar 78*d*, extending from an intermediate point along the length of the corresponding legs 77*a*, 77*b* to provide additional protection.

Figure 9:
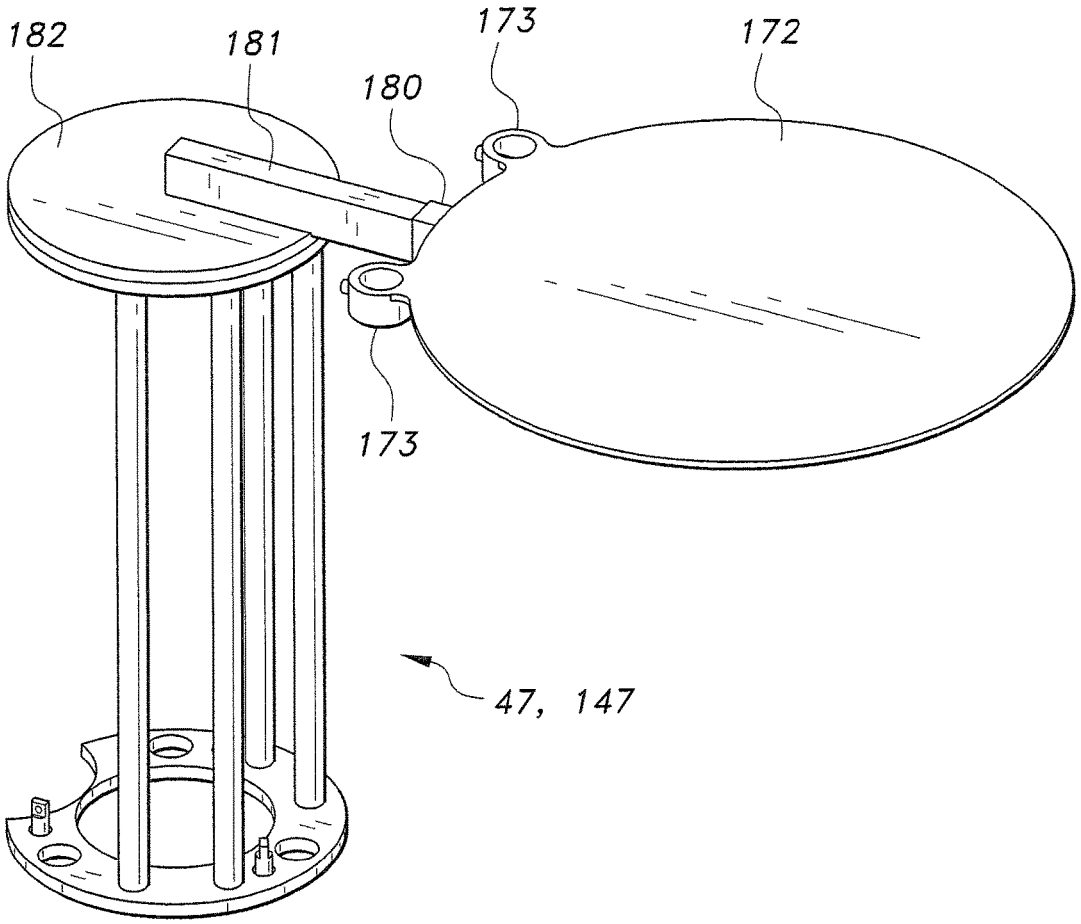
FIG. 9 is a perspective view of an alternative platform assembly for the elevating lift shown in FIG. 1.
Figure 10:
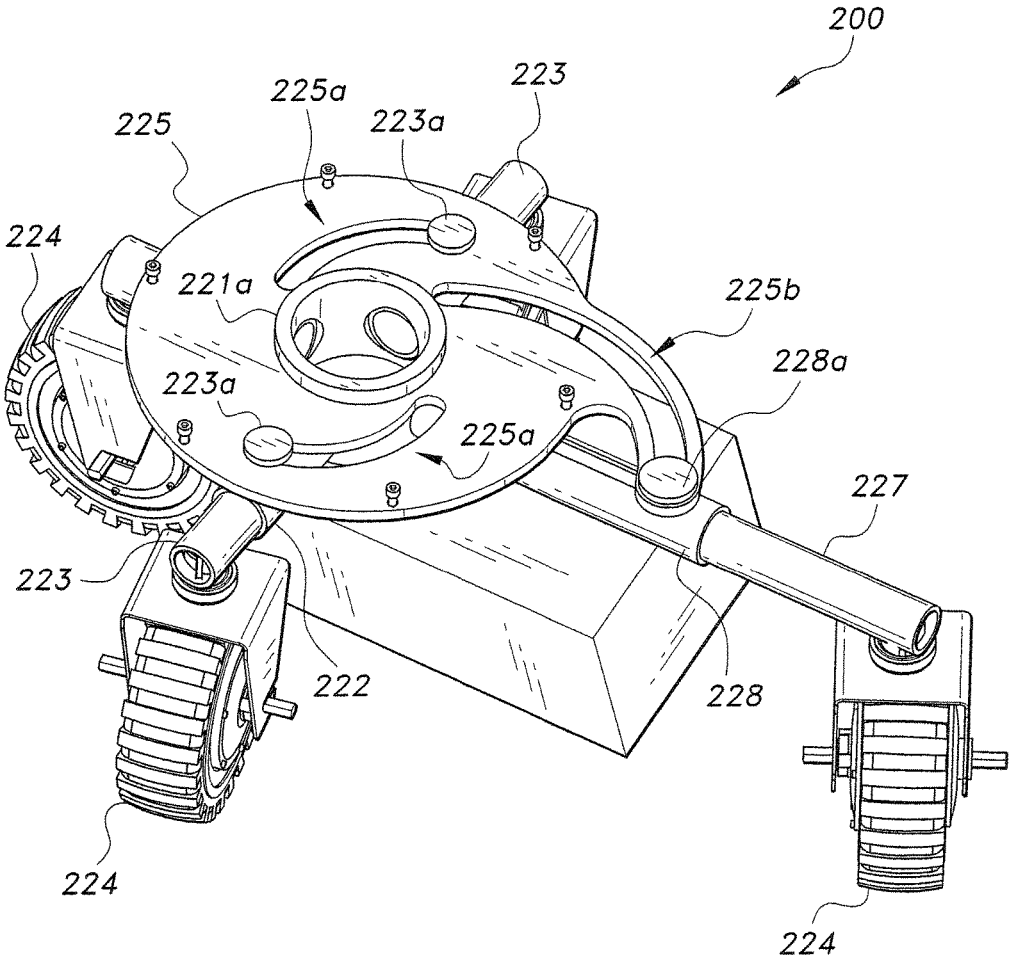
FIG. 10 is a perspective view of an alternative extension assembly for the base in the elevating lift shown in FIG. 1.

Another embodiment of the platform assembly 70 is shown in FIG. 9. In this embodiment, a platform 172 is constructed to be adjustably positioned in various ways. The platform assembly 70 includes a rotary base or turntable 182 mounted to the top of the third telescoping cage 47, 147. This enables the platform 172 to be positioned at any desired angle. An elongate adjustment beam 181 extends radially from the rotary base 182 and couples to a bracket 180 on the rotary base 172. The bracket 180 enables the platform 172 to be adjustably positioned along the length of the adjustment bar 181. The position may be fixed by similar means as that applied to the mount collars 73, 173. As with the platform 72, it can be seen that the platform 172 is constructed to provide at least two degrees of adjustable positioning movement. The platform 172 is also extendable so that the support area may be positioned within a certain predetermined range from the turntable 182. The platform 172 may be constructed in any suitable shape apart from those shown in the Figures. Furthermore, one or more elevating lifts 10 may be combined and positioned so as to couple the respective platforms 72, 172 together and form an expanded platform.

Maintaining the center of mass (CM) for the elevating lift 10 is required for stable balance. In the embodiment shown in FIGS. 1 and 2, the CM is generally along the central axis of the lift system 30. However, the platform assembly 70 shown in FIG. 9 places the CM somewhere radially offset from the central axis. Though the base assembly 20 may be suitably stable for most instances, especially the embodiment shown in FIGS. 1 and 2, the base assembly 20 may not be sufficiently stable for the embodiment shown in FIG. 9.

To compensate for the cantilevered weight of the platform 172, the elevating lift 10 may be provided with an alternative stabilizer base assembly 200. The stabilizer base assembly 200 is similar to the stabilizer base assembly 20 and includes a plurality of casters 224, a plurality of elongate support spokes 222 extend radially from a central hub 221*a*, and a plurality of elongate support legs 23 connecting the casters 224 to the support spokes 222. Just as with the stabilizer base 20, at least two of the casters 224 are extendable between minimal and maximum stable positions via corresponding actuator pins 223*a* riding along actuator slots 225*a* in response to selective rotations of a stabilizing actuator 225. The arc of the actuator slots 225*a* and the extent of the support legs 223 are identical. It is noted, however, that they may be different.

The stabilizer base assembly 200 also includes an elongate support spoke 228 and an elongate support leg 227 longer in length than the others. To insure full extension of the support leg 227, a longer actuator slot 225*b* extends out of the periphery of the stabilizing actuator 225 where the actuator slot 225*b* has a more pronounced arc profile compared to the others. An actuator pin 228*a* connected to the support leg 227 rides along the actuator slot 225*b* to extend the connected caster 224. As previously described, the more pronounced arc follows the Archimedean spiral or any other approximate curve approaching an Archimedean spiral so that for the same arcuate segment of rotation that effects the other casters 224 resulting in a relatively short travel distance of the support legs 223, a much longer travel length is accomplished by the support leg 227. This longer extension will suitably counteract any potential instability that may exist with the platform assembly 70 shown in FIG. 9.

It is to be understood that the elevating lift 10 encompasses a variety of alternatives. For example, the elevating lift 10 may be constructed from any durable and high strength materials, such as metals, plastics, composites, and/or combinations thereof. The platform 72, 172 and guardrail 75 may be provided in any desired shape. Though the telescoping cage assembly 40, 140 has been described as using three telescoping cages and round bars for support beams, the elevating lift 10 may be constructed with more or less than the three telescoping cages as well as different cross sectional geometries for the support beams.

It is to be understood that the present invention is not limited to the embodiments described above, but encompasses any and all embodiments within the scope of the following claims.

We claim:

1. An elevating lift, comprising:

a stabilizer base assembly having a plurality of extendable casters to set degree of stabilization for the elevating lift, the stabilizer base assembly comprising:

a movable base, the movable base having a central hub;

a plurality of elongate support spokes extending radially from the central hub at predetermined angular spacing, at least one of the support spokes having an elongate guide slot formed thereon;

an elongate support leg slidably mounted inside each of the support spokes, the support leg having one of the casters mounted to one end of the support leg, the support leg having an actuator pin extending radially from the opposite end of the support leg, the actuator pin riding in the guide slot of the at least one of the support spokes to facilitate extension and retraction of the caster;

a rotary stabilizing actuator rotatably mounted to the central hub, the stabilizing actuator having a plurality of arcuate actuator slots formed therein, the actuator pin extending through a corresponding one of the actuator slots to ride therein; and a base cover covering the stabilizing actuator;

wherein selective rotation of the stabilizing actuator forces the actuator pin to extend or retract the corresponding support leg and mounted caster;

a lift system mounted to the stabilizer base assembly; and a platform assembly mounted atop the lift system, the platform assembly having a platform for supporting a user and objects thereon, the lift system having a plurality of telescoping cages coupled to the platform to selectively raise and lower the platform to a desired height.

2. An elevating lift, comprising:

a stabilizer base assembly having a plurality of extendable casters to set degree of stabilization for the elevating lift, the stabilizer base assembly comprising:

a movable base, said movable base having a central hub;

a plurality of elongate support spokes extending radially from the central hub at predetermined angular spacing, at least one of the support spokes having an elongate guide slot formed thereon;

an elongate support leg slidably mounted inside each of the support spokes, said support leg having one of said casters mounted to one end of said support leg, said support leg having an actuator pin extending radially from the opposite end of said support leg, the actuator pin riding in the guide slot of the at least one of the support spokes to facilitate extension and retraction of said caster;

a rotary stabilizing actuator rotatably mounted to the central hub, the stabilizing actuator having a plurality of arcuate actuator slots formed therein, the actuator pin extending through a corresponding one of the actuator slots to ride therein, wherein said stabilizing actuator comprises a flat substantially circular disc; and a base cover covering the stabilizing actuator, wherein selective rotation of the stabilizing actuator forces the actuator pin to extend or retract the corresponding support leg and mounted caster, a lift system mounted to the stabilizer base assembly; and a platform assembly mounted atop the lift system, the platform assembly having a platform for supporting a user and objects thereon, the lift system having a plurality of telescoping cages coupled to the platform to selectively raise and lower the platform to a desired height, each telescoping cage having a plurality of elongate support beams defining a cage configuration.

3. The elevating lift according to claim 2, further comprising an elongate handle extending axially from a face of said stabilizing actuator, said base cover having an arcuate slot formed therein, the handle extending through the arcuate slot of said base cover, wherein selective operation of the handle facilitates rotation of said stabilizing actuator.

4. The elevating lift according to claim 2, wherein one of said support spokes, said support legs, and the actuator slots is longer than the remainder of said support spokes, said support legs, and the actuator slots.

5. The elevating lift according to claim 2, wherein the actuator slots each substantially define an Archimedean spiral.

6. The elevating lift according to claim 2, wherein said lift system comprises:

a drive assembly mounted to said stabilizer base assembly, the drive assembly having a selectively extendable mast beam acting on said plurality of telescoping cages;

a drive train coupled to said plurality of telescoping cages; and a plurality of angularly spaced guide rods coupled to one of said telescoping cages to support and to guide the raising and the lowering of said plurality of telescoping cages.

7. The elevating lift according to claim 6, wherein said plurality of telescoping cages comprises a first telescoping cage slidably mounted to said plurality of angularly spaced guide rods, a second telescoping cage slidably mounted to said first telescoping cage, and a third telescoping cage slidably mounted to said second telescoping cage.

8. The elevating lift according to claim 7, wherein said drive train comprises:

at least one sprocket mounted to said first telescoping cage;

a first elongate chain trained around the at least one sprocket, the first chain having a first anchor at one end fixed to said stabilizer base assembly, and a second anchor at the opposite end fixed to said second telescoping cage;

at least one sprocket mounted to said second telescoping cage; and a second elongate chain trained around the at least one sprocket on said second telescoping cage, the second chain having a first anchor at one end fixed to said first telescoping cage and a second anchor at the opposite end fixed to said third telescoping cage;

wherein extension and retraction of said mast beam causes the first and second chains to raise and lower said telescoping cages.

9. The elevating lift according to claim 2, wherein said platform assembly comprises at least one mount collar extending from said platform and an adjustable guardrail mounted to the at least one mount collar.

10. The elevating lift according to claim 9, wherein said at least one mount collar comprises two mount collars and said guardrail comprises:

an arcuate bridge plate mounted on said base assembly, the bridge plate having opposing ends;

elongate first and second legs fixed to and extending upward from the opposing ends of the bridge plate, each of the legs passing through a corresponding mount collar;

a first hand bar extending orthogonally from the first leg;

a second hand bar extending orthogonally from the second leg, the first and second legs being pivotal between open and closed positions, the first and second legs being slidable on said mount collars to adjust height of said guard rail; and a lock attached to the first and second bars for securing the first and second bars in the closed position.

11. The elevating lift according to claim 10, wherein said guardrail further comprises third and fourth hand bars extending from said first and second legs, respectively, the third and fourth hand bars being spaced lower than said first and second hand bars.

12. The elevating lift according to claim 2, wherein said platform is rotatable with respect to said lift system in a plane parallel to said base assembly to adjust angular position of said platform.

* * * * *